US005528816A

United States Patent [19]

Donini et al.

[11] Patent Number: 5,528,816

[45] Date of Patent: Jun. 25, 1996

[54] METHOD AND PLANT TO PRODUCE STRIP, STARTING FROM THIN SLABS

[75] Inventors: Estore Donini, Vimercate; Gianpietro Benedetti, Campoformido, both of Italy

[73] Assignee: Danieli & C. Officine Meccaniche SpA, Buttrio, Italy

[21] Appl. No.: 405,194

[22] Filed: Mar. 16, 1995

[30] Foreign Application Priority Data

Mar. 31, 1994 [IT] Italy ..... UD94A0051

[51] Int. Cl.[6] ..... B23P 23/00; B22D 11/12

[52] U.S. Cl. ..... 29/527.7; 72/201; 164/417; 164/476

[58] Field of Search ..... 29/527.7; 164/476, 164/417; 72/201

[56] References Cited

U.S. PATENT DOCUMENTS

| | | | |
|---|---|---|---|
| 4,630,352 | 12/1986 | Gingburg et al. | 29/527.7 |
| 4,675,974 | 6/1987 | Connolly | 29/527.7 |
| 4,793,168 | 12/1988 | Kimura | 29/527.7 X |
| 4,817,703 | 4/1989 | Rohde et al. | 29/527.7 X |
| 4,829,656 | 5/1989 | Rohde | 29/527.7 |
| 4,976,024 | 12/1990 | Kimura | 29/527.7 X |
| 5,150,597 | 9/1992 | Sekiya et al. | 29/527.7 X |
| 5,235,840 | 8/1993 | Blazevic . | |
| 5,303,766 | 4/1994 | Kreijger et al. | 29/527.7 X |
| 5,329,688 | 7/1994 | Arvedi et al. | 29/527.7 |

FOREIGN PATENT DOCUMENTS

| | | | |
|---|---|---|---|
| 320846 | 6/1989 | European Pat. Off. | B21B 1/06 |
| 58-32506 | 2/1983 | Japan | 29/527.7 |
| 62-89502 | 4/1987 | Japan | 29/527.7 |
| 2184675 | 7/1987 | United Kingdom | B22D 11/04 |
| WO89/11363 | 11/1989 | WIPO | B22D 11/12 |

OTHER PUBLICATIONS

Induction Heating for Direct Linking, Quickenden; Dec. 1989, No. 12 of Steel Times Incorporating Iron & Steel.

Stahl & Eisen, vol. 108, No. 3, Feb. 1988 pp. 99–109; Fleming et al.

Patent Abstracts of Japan, vol. 7, No. 55 (M–198) 3/83 & JP A–57–2–2 952 Shin Nippon abstract 13 Dec. 1982.

Patent Abstracts of Japan, vol. 8, No. 112, (M–298) May 1984 & JP A 59 021 457 Shin Nippon Seitetsu 3 Feb. 1984.

*Primary Examiner*—Carl J. Arbes

*Attorney, Agent, or Firm*—Antonelli, Terry, Stout & Kraus

[57] ABSTRACT

Plant and method to produce strip (11), starting from thin slabs (29) produced by a continuous casting plant (12), whereby the thin slab (29) undergoes at least one descaling step followed by a roughing step and a finishing step before being wound in coils, the mould being subjected to an oscillation action the conformation of which is at least partly correlated with the casting parameters (at least the speed, temperature and complex structure of the steel), and whereby the thin slab (29) leaving the crystalliser of the continuous casting plant (12) has a thickness between 70 and 100 mm. and travels at a speed between 2 and 10 metres per minute, the thin slab (29), before the roughing rolling step, staying at least in a furnace (16) at least maintaining the temperature of the slab (29) for a period correlated at least with the characteristics of the surface defects of the thin slab (29), the roughing rolling step being carried out at an outgoing speed of about 1.3 to 4 metres per second so as to produce as output a bar (30) having a thickness between 16 and 40 mm., whereas the finishing rolling step is started with a speed between 30 and 85 metres per minute, depending on the finished thickness of the strip (11) and the thickness of the bar (30), each step of the method being controlled by monitors and managed by a data processing assembly (31) structured with a plurality of differentiated levels of management.

19 Claims, 4 Drawing Sheets

METHOD AND PLANT TO PRODUCE STRIP, STARTING FROM THIN SLABS

BACKGROUND OF THE INVENTION

This invention concerns a method to produce strip, starting from thin slabs produced by a continuous casting plant.

The invention concerns also a plant to produce strip, starting from thin slabs, the plant being suitable to carry out the above method.

The state of the art includes various types of plants to produce strip, starting from thin slabs produced continuously by continuous casting, but all these plants entail a series of problems which have still not been overcome.

Some plants of the state of the art, which we shall call type "A" for simplicity, tend in particular to roll the thin slab with thicknesses, when entering the rolling train, which are greater than the conventional thicknesses so as to be able to save energy in the heating of the thin slab.

Other plants, which we shall call type "B" for simplicity, tend to introduce a direct rolling process with one or more roughing rolling mill stands immediately downstream of the casting plant and upstream of the shearing step so as to produce as output from the roughing rolling mill stands a bar having a thickness within the traditional range of 18 to 35 mm. and even less if a reel in the hot state is included on which the bar is wound.

In such plants the thin slab with a thickness of about 40–60 mm. is rolled on one or more roughing rolling mill stands, which work coupled to, and immediately downstream of, the continuous casting plant.

Next, the bar with a thickness of about 18–35 mm. is sheared and wound in a coil and is then unwound and sent to the finishing train.

These systems provide the advantage that the finishing train works under proper known conditions inasmuch as it is working on a bar of a conventional thickness.

As against this, the system entails a plurality of drawbacks due to the very low rolling speed in the roughing rolling mill stand or stands.

To be more exact, the very low rolling speed leads to the creation of pyrocracks in the processing rolls and to the formation of scale in the roughing rolling mill stands owing to the high temperature and low speed.

These plants therefore involve the risk that the scale may be impressed on the processing rolls and thus may reduce their working life and efficiency considerably.

Moreover, the systems to oscillate the moulds for thin slabs are designed to keep the functioning of their oscillation constant.

Furthermore, the methods of the state of the art tend to make as short as possible the time of transfer of the thin slab from the continuous casting plant to the rolling mill so as to reduce the stay times and therefore the losses by oxidation.

This approach, which is now deeply entrenched in this highly specialised field of technology, on the one hand tends to save energy but on the other hand entails an unsatisfactory finished product. The reasons why the finished product is unsatisfactory are manifold.

The high casting speed with thin slabs having a thickness of 40–60 mm. in plants with the normal surfaces of the meniscus in the crystalliser make difficult a proper melting of the powders and therefore make unsatisfactory the lubrication which the molten powders should perform, so that the surface of the thin slab is impaired accordingly.

The method of working of the oscillation units normally employed in the moulds for thin slabs does not adapt the type of oscillation to the specific and properly timed requirements of the thin slab being formed.

This situation prevents a correct linear release from the wall of the crystalliser and has an unfavourable effect on the surface of the thin slab.

The swift progress of the thin slab in the temperature-maintaining furnace does not enable the surface layer of the thin slab to be affected favourably in a desired manner.

The reduced speeds of the roughing rolling have an unfavourably effect on the surface of the finished product since hard fragile scale forms.

In plants of type "A" the use of a great thickness (normally 45 mm. or more) of the bar entering the finishing train leads, on the one hand, to a greater production of scale and, on the other hand, to the production of scale with a high content of $Fe_3O_4$ or $Fe_2O_3$.

This is due to the fact that the surface temperature of this type of bar during rolling is always high and, even when it is brought down to lower values (for instance, by descaling with jets of water), the great reserve of heat within the bar and the low rolling speed take the surface of the bar quickly back up to a high temperature at which the scale is produced swiftly and is produced with hard oxides.

This scale not only creates surface faults on the strip being produced but also leads to a great abnormal wear of the rolling rolls.

It is known that, if the surface temperature of a bar is kept between a minimum temperature of 700° C. and a maximum temperature of 930° C., the oxides that form consist mainly of FeO, while the percentages of $Fe_3O_4$ and $Fe_2O_3$ are very low.

FeO produces a malleable scale that can be rolled and forms a continuous and substantially even film, which does not break readily and therefore substantially does not cause problems and does not produce surface faults during subsequent rolling of the bar in the finishing train.

Instead, $Fe_3O_4$ and $Fe_2O_3$ are very hard, fragile oxides which, when rolled, break in an uneven manner and cause wear in the processing rolls and surface faults, which lower the quality of the strip produced.

In plants of type "A" the thermal capacity of the bar being rolled is such that the heat released from the core of the bar has enough time to bring the surface temperature of the bar above the optimum value of 930° C.

FIG. 1*a* is a diagram of a finishing train of a known plant producing strip from thin slabs, the train comprising in this case six finishing stands, with an emergency shears and a descaling unit positioned upstream of the train.

In this plant the bar reaches the inlet of the finishing train with a thickness of at least 40 mm. and with an intake speed between about 20 and 35 metres per minute.

FIG. 1*b* is a diagram of the development of the surface, internal and mean temperatures respectively of the bar in the finishing train of FIG. 1*a*.

It is clear that the surface temperature at several measurements is above 930° C., thereby generating scale consisting of $Fe_3O_4$ and $Fe_2O_3$.

FIG. 1*c* shows a plant of the type "A", in which can be seen, in sequence and in a rough sketch, a mould with a relative continuous casting plant for thin slabs, a shears which shears to size the thin slab leaving the continuous casting plant, a heating furnace five times as long as the length of the sheared slab, a shears for service shearing, a finishing train consisting of six four-high rolling mill stands and a finishing treatment segment.

Normally in plants of type "A" the thin slab reaches the finishing rolling mill stands with a thickness of 50–55 mm.

This type of plant, besides the defects already disclosed, works badly since the rolling mill stands work at a low speed and the danger of growth of scale is constant and great.

FIG. 1*d* shows a plant of the type "B", in which can be seen, in sequence and in a rough sketch, a mould with a relative continuous casting plant for thin slabs, this continuous casting plant including a treatment of soft-reduction of the thin slab, two roughing rolling mill stands, an emergency shears, a winding unit, another emergency shears, a finishing assembly consisting of four rolling mill stands and a finishing treatment segment.

In this type of plant, besides the defects already disclosed, the roughing rolling mill stands receive a thin slab with a thickness of about 40–45 mm. and therefore work very badly.

U.S. Pat. No. 5,235,840 arranges that a continuous, intense removal of scale is carried on so as to eliminate from the surface of the bar the hard scale of iron oxides so that such scale does not affect the final result of the rolling.

Such a lay-out is shown in FIG. 2*a* and the relative diagram of the temperatures is shown in FIG. 2*b*. This teaching provides for elimination of the scale, which forms after the conventional descaling unit, immediately upstream of the rolling mill stands of the finishing train by means of appropriate auxiliary descaling units.

Without these descaling units the hard scale detached unevenly would generate anomalous wear of the rolling rolls and, in some cases, would remain pressed into the surface of the strip.

These intermediate descaling units cool, meanwhile, the surface of the bar being fed, but owing to the low speed of feed in the space between the descaling unit and the relative rolling mill stand the surface temperature rises again to values very close to the physiological limit of 930° C. This has the effect that there is the risk that scale of very hard oxides is produced on the surface of the bar before the rolling performed by the finishing stand.

In fact, these plants entail the problem that the slab enters the finishing rolling mill at a very low speed, which produces an outgoing bar with a poor surface quality, and the bar may have the scale impressed on its surface.

Moreover, these plants have a very limited storage capacity, which may create problems if the line downstream of the storage has to be halted, for instance by a breakdown or for maintenance.

The small size of the storage area causes the need, where the downstream line is halted, to send for scrap the slabs produced by the continuous casting plant or else to halt the continuous casting plant itself.

SUMMARY OF THE INVENTION

The present applicants have designed, tested and embodied this invention to overcome the shortcomings of the state of the art and to achieve further advantages.

The purpose of the invention is to provide a method to produce strip, starting from thin slabs, the method enabling a finished product of a high quality to be obtained.

In an overall perspective of the process, the method according to the invention arranges to take corrective action on the configuration of the mould, on the casting method, on the method of feed of the thin slab in the heating furnace and on the rolling method so as to produce a finished strip having a high, desired, intrinsic surface quality.

To be more exact, given an equal output, in the method according to the invention the continuous casting of the thin slab is carried on at a speed relatively lower than that of a continuous casting with a thin slab 40–60 mm. thick inasmuch as the thin slab leaving the crystalliser has relatively great thicknesses between 70 and 100 mm.

This contrivance makes it possible to have a casting chamber in the crystalliser with an ample surface and with great volumes, thus reducing the turbulence of the molten metal, improving the melting of the lubricating protective powders and improving the uniformity of the temperature and control thereof in the crystalliser itself. The better melting of the powders optimises their lubricating effect between the sidewall of the crystalliser and the forming skin of the thin slab. Moreover the proper control of the temperature improves the product.

In the method according to the invention a mould can be used advantageously which is of a type having movable sidewalls to adjust the width of the thin slab, the casting chamber of the mould extending along the longitudinal length of the mould and including a lateral enlargement at least in one long sidewall.

The lateral enlargement may be constant along the whole length of the casting chamber or may decrease substantially progressively in the lengthwise and/or transverse directions as it proceeds towards the outlet of the crystalliser.

According to another variant the mould may have a terminal segment with a constant cross-section.

A mould of this type with a lateral enlargement makes possible a still more ample meniscus and thus improves the melting capacity of the lubricating powders; moreover, the great volume of molten metal thus produced lessens the turbulence and obviates the incorporation of powders and slag in the thin slab, thus improving the quality of the thin slab produced.

Moreover, by using a mould of the above type an improvement is achieved in the internal qualities of the thin slab, which can undergo thereafter a soft-reduction step with considerable technological advantages provided by the differentiated longitudinal central mass thus made greater than the lateral masses included in the thin slab leaving the crystalliser.

In the method according to the invention the oscillation of the mould is brought about intentionally with a hydraulic system so that it can be adjusted continuously during the casting as regards its amplitude, frequency and waveform, depending on a plurality of casting parameters, (speed, temperature, types of steel, etc.).

In a preferred but not restrictive form the oscillation of the mould is carried out according to an asymmetric cycle by having a very high speed of lowering of the mould and a lower speed of re-ascent of the mould. This oscillation cycle causes a sharp descent of the mould and a slow reascent, thus improving release of the slab.

The method according to the invention arranges also to deliver the thin slab leaving the continuous casting plant into a furnace, which at least maintains the temperature of the slab and may even heat the slab during a stay time such as will produce the desired thickness of scale, this thickness of scale being intentionally correlated with the depth of the surface micro-defects in the thin slab.

The method according to the invention provides for the first rolling step in the roughing train to be carried out so as to produce a bar which, when rolled in the finishing train, enables parameters of thickness, speed of feed and surface temperature to be used which are such as to prevent the formation of scale with hard, fragile oxides.

The method according to the invention therefore makes it possible, on the one hand, to reduce wear and abrasion of the rolls of the stands of the finishing train and, on the other hand, to prevent the produced scale from creating surface defects on the strip.

The method according to the invention frees the roughing step from depending on the continuous casting process, in which the thin slab moves forward at a speed between 2 and 10 metres per minute, and carries out the step of roughing the thin slab at an optimum rolling speed of about 1.3 to 4 metres per second when leaving the roughing rolling stands.

According to the invention the bar leaving the roughing train has a thickness between 16 and 40 mm., but advantageously 20–25 mm.

The bar with a maximum thickness of 40 mm. is then introduced into the finishing train at an intake speed between 30 and 85 metres per minute, depending on the intended finished thickness of the strip and the intake thickness of the bar entering the finishing train.

In the method according to the invention the bar leaving the roughing train undergoes a descaling step, which also brings its surface temperature down to about 700° C.

With the method according to the invention the surface temperature of the bar being rolled in the finishing train is substantially always between 700° and 930° C., with the result that the reduced quantity of the scale formed consists essentially of malleable oxides such as FeO.

According to a first arrangement of the invention the method to produce strip according to the invention is of a continuous type, and the bar leaving the roughing train and therefore entering the finishing assembly cooperates with temperature-maintaining means consisting of a suitably insulated tunnel furnace equipped with burners to maintain the temperature of the bar. This tunnel furnace also may have the purpose of increasing the temperature of the bar.

In this arrangement the tunnel furnace advantageously includes a hood which can be opened to facilitate access to the bar being processed in the event of an obstruction downstream;

In a second arrangement of the invention the method to produce strip according to the invention is of a type with a head-to-tail inversion of the bar leaving the roughing train and provides for the bar to be introduced into a coil box, in which the bar is wound to form a coil before being sent to the finishing train.

The coil box includes advantageously a winding station and an unwinding station so as to make possible at the same time the winding of a new coil and the unwinding of the coil just completed so as to feed the downstream finishing train.

The production plant according to the invention comprises other auxiliary units such as, for instance, measurement units at the roughing train and/or finishing train. These measurement units have the task of checking the temperature, thickness, width and flatness of the slab and strip as well as the transverse profile of the strip so as to ensure by means of the relative checking systems that the outgoing product is of a quality possessing the desired properties.

The strip leaving the finishing train is sent advantageously to a strip-coiling unit for production of coils, which are then removed from the plant.

According to the invention the whole system is controlled and managed by a data processing assembly structured with a plurality of specialised data processing units divided into a plurality of differentiated levels of management and interacting on the basis of those different levels.

This data processing assembly controls not only the temperature of the slab and the working conditions of the various components of the plant such as speed and temperature but also controls the development of the cycle, storing anomalies in the extraction of the slab from the crystalliser, imperfect adjustments of the machines and/or of the furnaces, lack of working continuity and any other faults which may affect the finished result.

BRIEF DESCRIPTION OF THE DRAWINGS

The attached figures are given as a non-restrictive example and show three preferred lay-outs of the invention as follows.

DETAILED DESCRIPTION OF THE PREFERRED EMBODIMENTS

Figure 1A:
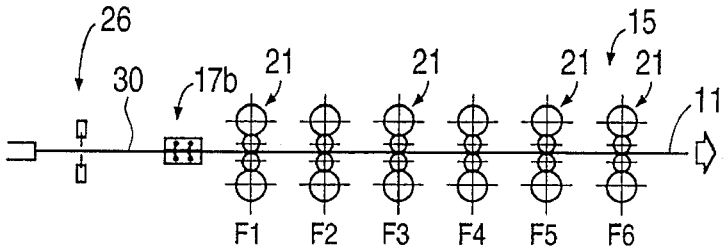
FIG. 1*a* is a diagram of the finishing train of a plant of a known type to produce strip, starting from thin slabs with an ingoing thickness between 40 and 60 mm. on entry into the rolling train.
Figure 1B:
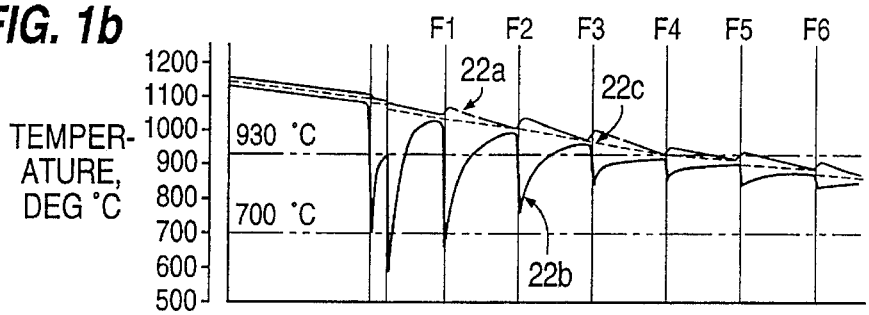
FIG. 1*b* is a diagram of the development of the surface, internal and mean temperatures of a bar in the finishing train of FIG. 1*a;*
Figure 2A:
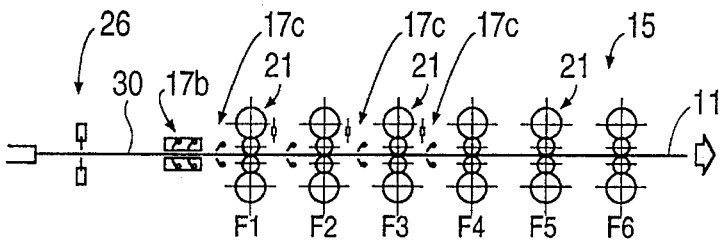
FIG. 2*a* is a diagram of the finishing train of the plant to produce strip, starting from thin slabs, according to the disclosure of U.S. Pat. No. 5,235,840.
Figure 2B:
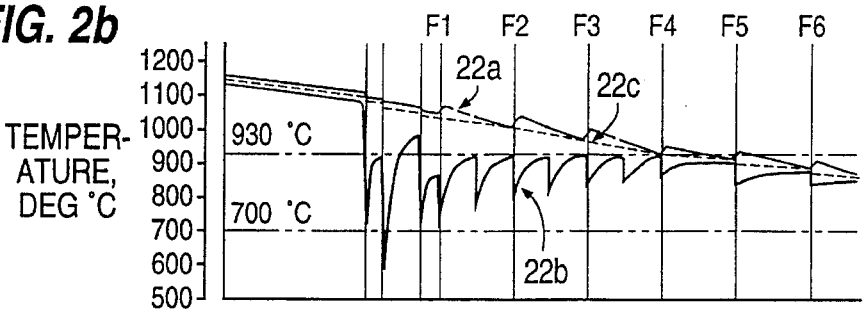
FIG. 2*b* is a diagram of the development of the surface, internal and mean temperatures of a bar in the finishing train of FIG. 2*a;*

The reference number 10 in the attached figures denotes generally a plant to produce strip, starting from thin slabs 29, according to the invention.

The production plant 10 according to the invention enables strip 11 to be produced from a plant 12 continuously casting thin slabs 29, the strip 11 having an excellent surface quality.

The method according to the invention arranges to cast at a speed suitable to produce a thin slab 29 of a thickness between 70 mm. and 100 mm., this low casting speed being between 2 and 10 metres per minute.

In the method according to the invention the mould is associated with a hydraulic oscillation unit, which subjects the mould to an oscillatory action, the parameters of which, such as amplitude, frequency and waveform, are at least correlated with the casting parameters, such as casting speed and temperature.

In the method according to the invention all the parameters of the oscillation of the mould, such as amplitude and frequency of oscillation and waveform, can be adjusted continuously during the casting according to the casting speed and temperature and the grade of the steel.

Figure 7:
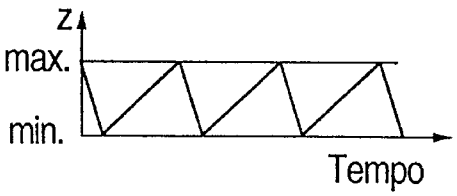
FIG. 7 is a diagram of the development of the vertical position of the mould as a function of time during continuous casting.

In a preferred, but not restrictive, form of the invention the mould is caused to oscillate advantageously so as to have a speed of descent much greater than its speed of reascent, as is shown in the diagram of FIG. 7 as an example.

The invention arranges that a shearing unit 26 is included downstream of the continuous casting plant 12 and shears to size the emerging thin slab 29.

The method according to the invention arranges to carry out rolling steps in the rolling assemblies, namely a roughing assembly 14 and a finishing assembly 15 respectively, at high speeds of feed of bars 30 having a modest thickness.

To be more exact, the production plant 10 according to the invention enables the roughing step to be carried out on a thin slab 29 travelling at a speed of about 1.3 to 4 metres per second when leaving the roughing stand and makes it possible to have a bar 30 of a thickness between 16 and 40 mm., but advantageously between 20 and 25 mm., at the inlet of the finishing train 15.

The above two features enable a strip 11 to be produced with a minimum formation of scale and the surface temperature of the bar 30 within the finishing train 15 to be kept between 700° and 930° C., with a resulting formation of scale consisting mainly of malleable oxides such as FeO.

The strip 11 produced by the method according to the invention is therefore of a high quality and substantially free of surface faults.

Figure 3:
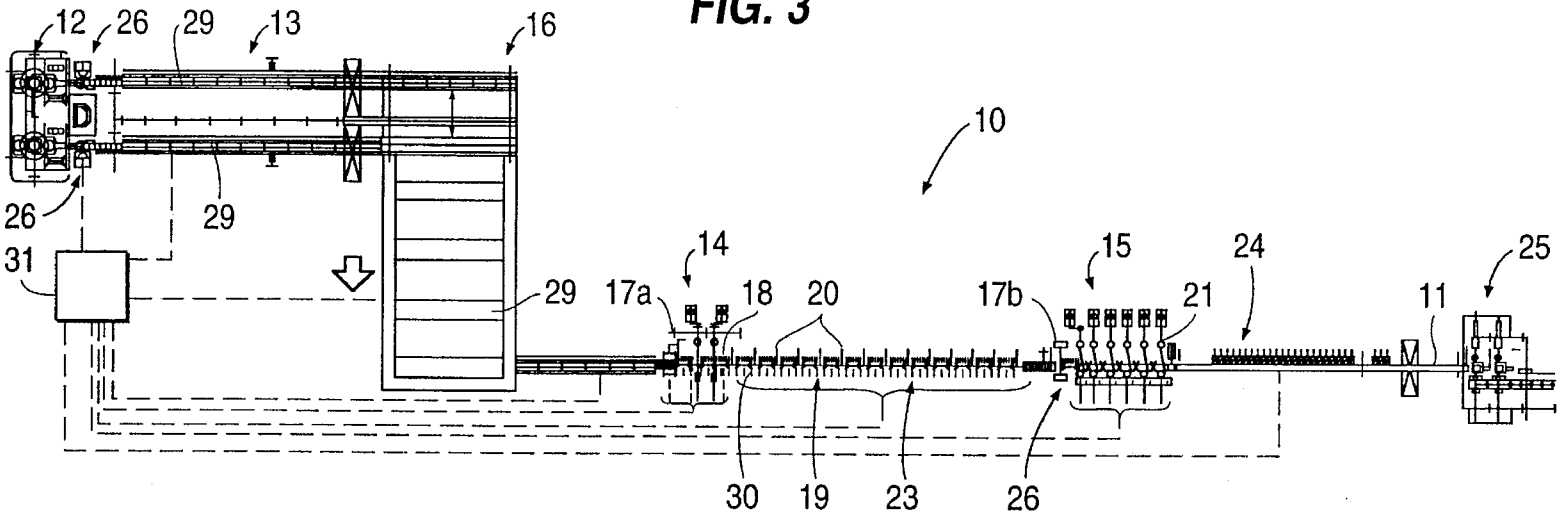
FIG. 3 is a plan view of a plant to produce strip continuously, starting from thin slabs, according to the invention.
Figure 4:
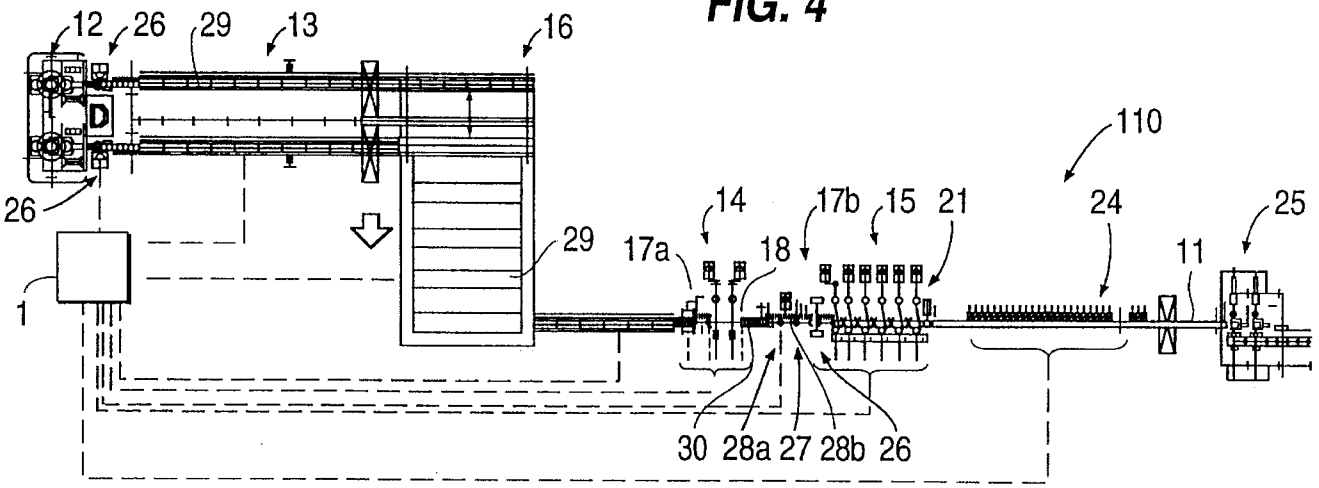
FIG. 4 is a plan view of a first variant of the plant to produce strip, starting from thin slabs, according to the invention.

According to a first lay-out the production plant 10 is of a continuous type (FIG. 3), whereas according to a second lay-out of the invention the production plant 110 includes a head-to-tail inversion of the bar 30 (FIG. 4).

The continuous production plant 10 comprises a continuous casting plant 12 consisting in this case of two parallel continuous casting units, each of which is upstream of a temporary store 13 for thin slabs 29 (or else upstream of a furnace performing the task of a heating furnace or a temperature-maintaining furnace), the length of the temporary store 13 being about four to five times the length of the sheared slab.

According to a variant the continuous casting plant 12 consists of one single casting unit.

A temperature monitor is included downstream of the continuous casting plant 12; a unit to monitor the temperature of the molten metal may be provided in cooperation with the crystalliser.

The store 13 enables the roughing assembly 14 to be freed from depending on the upstream continuous casting plant 12 and the roughing step to be therefore carried out at the desired speed.

Downstream of the temporary store 13 there is advantageously included a shearing unit 26 suitable, if so required, to shear the sheared slabs to a shorter size.

In this case a furnace 16 able at least to maintain the temperature of the thin slabs 29 is included downstream of the continuous casting plant 12 so as to increase the flexibility of the plant and to prevent any downtimes of the plant 10 in the event of accidents occurring upstream or downstream of the furnace 16.

This furnace 16 may make possible an axial feed of the thin slabs 29 or a feed at a right angle to the lengthwise axis of the thin slabs 29.

Moreover, this at least temperature-maintaining furnace 16 according to the invention enables the stay time of the thin slab 29 to be increased with a resulting formation of a scale having a thickness correlated with the depth of the micro-faults in the surface of the thin slab 29.

Moreover, this at least temperature-maintaining furnace 16 makes it possible to act by temperature and stay-time on the thin slab 29 according to the casting temperature or to the temperature of the thin slab 29 or to the composition of the steel alloy.

Downstream of the at least temperature-maintaining furnace 16 the thin slab 29 cooperates with a roughing assembly 14 comprising a vertical rolling mill stand and two horizontal rolling mill stands in this case.

According to a variant the roughing assembly 14 comprises horizontal stands alone.

According to a further variant the roughing assembly 14 comprises a horizontal rolling mill stand and a vertical rolling mill stand.

The thin slab 29 cooperates, upstream of the roughing assembly 14, with a first descaling unit **17*a* and with a possible measurement unit 18**.

In the example of FIGS. 3 and 4 the measurement unit 18 is shown downstream of the roughing assembly 14.

According to a variant the thin slab 29 is rolled on its sides by vertical rolling mill stands upstream of the first descaling unit **17*a***

The bar 30 cooperates, downstream of the roughing assembly 14, with a tunnel furnace 23 containing an insulated roller conveyor 19 to maintain the temperature of the bar 30. The tunnel furnace 23 contains advantageously a plurality of temperature-maintaining burners 20 and may include a movable hood system to facilitate access to the roller conveyor 19 for maintenance work or to remove the bar 30 in the event of an obstruction.

The bar 30 then cooperates with the finishing assembly 15, which generally comprises from four to seven horizontal rolling mill stands 21 to roll the bar 30 until a strip 11 of the desired thickness has been produced.

In this example an emergency shears 26 is included at the inlet of the finishing assembly 15 to shear the bar 30 in the event of accidents and/or breakdowns.

This emergency shears 26 also performs the cutting of the normal slabs into desired portions so as to obtain two or more coils of a reduced weight.

The bar 30 entering the finishing assembly 15 has a thickness between 16 and 40 mm., but advantageously between 20 and 25 mm.

At least one second descaling unit **17*b* positioned upstream of the finishing assembly 15 is included with the function of descaling and with the function of keeping the surface temperature of the bar 30** within the optimum range of 700° C.– 930° C.

The finishing assembly 15 shown in FIG. **2*a* is of the type disclosed in U.S. Pat. No. 5,235,840 and includes a plurality of auxiliary descaling units 17***c* positioned between one rolling mill stand 21 and the next one to carry out an intense and substantially continuous action to remove scale; this plant entails the shortcomings disclosed in the state of the art.

Figure 6A:
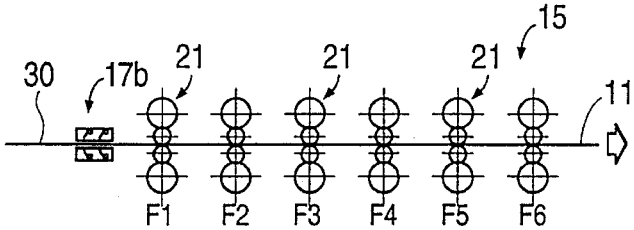
FIG. 6*a* is a diagram of the finishing train of the plant to produce strip, starting from thin slabs, according to the invention.

FIG. 6*a* shows as an example a diagram of a finishing assembly 15 of a plant 10 to produce strip 11 from thin slabs 29 according to the invention; in this case the finishing assembly 15 comprises six rolling mill stands 21 installed downstream of the second descaling unit 17*b*.

Figure 6B:
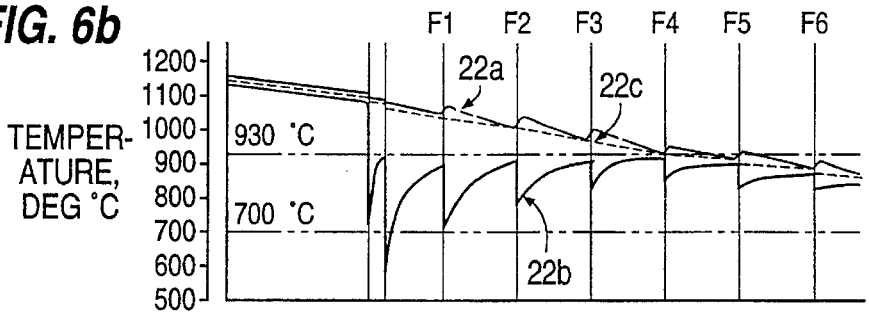
FIG. 6*b* is a diagram of the development of the surface, internal and mean temperatures of a bar in the finishing train of FIG. 6*a;*
Figure 1C:
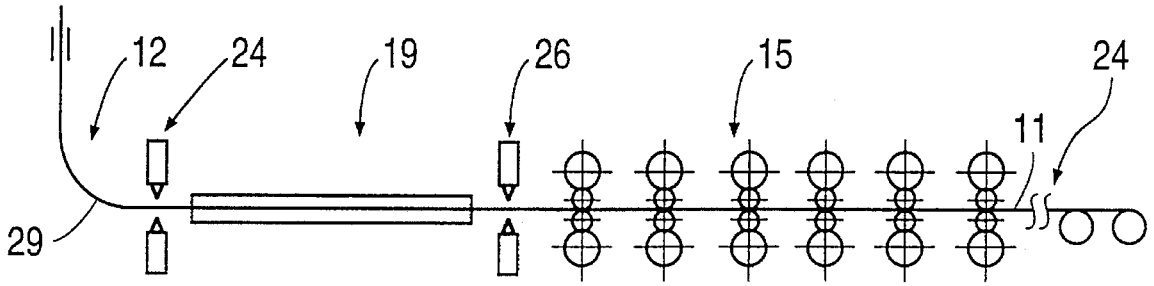
FIG. 1*c* is a diagram of a plant of the state of the art of type "A"
Figure 1D:
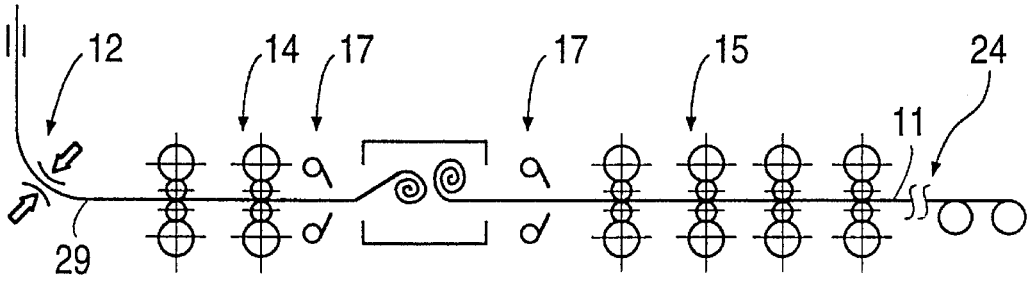
FIG. 1*d* is a diagram of a plant of the state of the art of type "B"

The diagram of FIG. 6*b* shows a possible development of the internal 22*a*, surface 22*b* and, with lines of dashes, mean 22*c* temperatures respectively of the bar 30.

The strip 11 leaving the finishing assembly 15 slides on a removal roller conveyor 24, which feeds the strip 11 to a winding unit 25.

In the plant 110 to produce strip 11 from thin slabs 29, as shown in FIG. 4, the tunnel furnace 23 is replaced by a coil box 27, in which there takes place the head-to-tail inversion of the bar 30 leaving the roughing train 14 before being fed to the finishing train 15.

A shearing unit 26 is included upstream and/or downstream of the coil box 27 and has the task of an emergency shears and of shearing the bar 30 to shorter lengths.

The coil box 27 includes advantageously a winding station 28*a* and an unwinding station 28*b*, with which a transfer unit cooperates in transferring the wound coil from the winding station 28*a* to the unwinding station 28*b*.

To be more exact, in the production plant 110 according to the invention the coil, after having been completely wound in the winding station 28*a*, is transferred to the unwinding station 28*b*, where the unwinding step begins.

According to a variant, when the bar 30 has been completely wound in the winding station 28*a*, the unwinding step begins and the coil is then transferred to the unwinding station 28*b* where the unwinding continues, while a new bar 30 can be wound in the winding station 28*a*.

Figure 5:
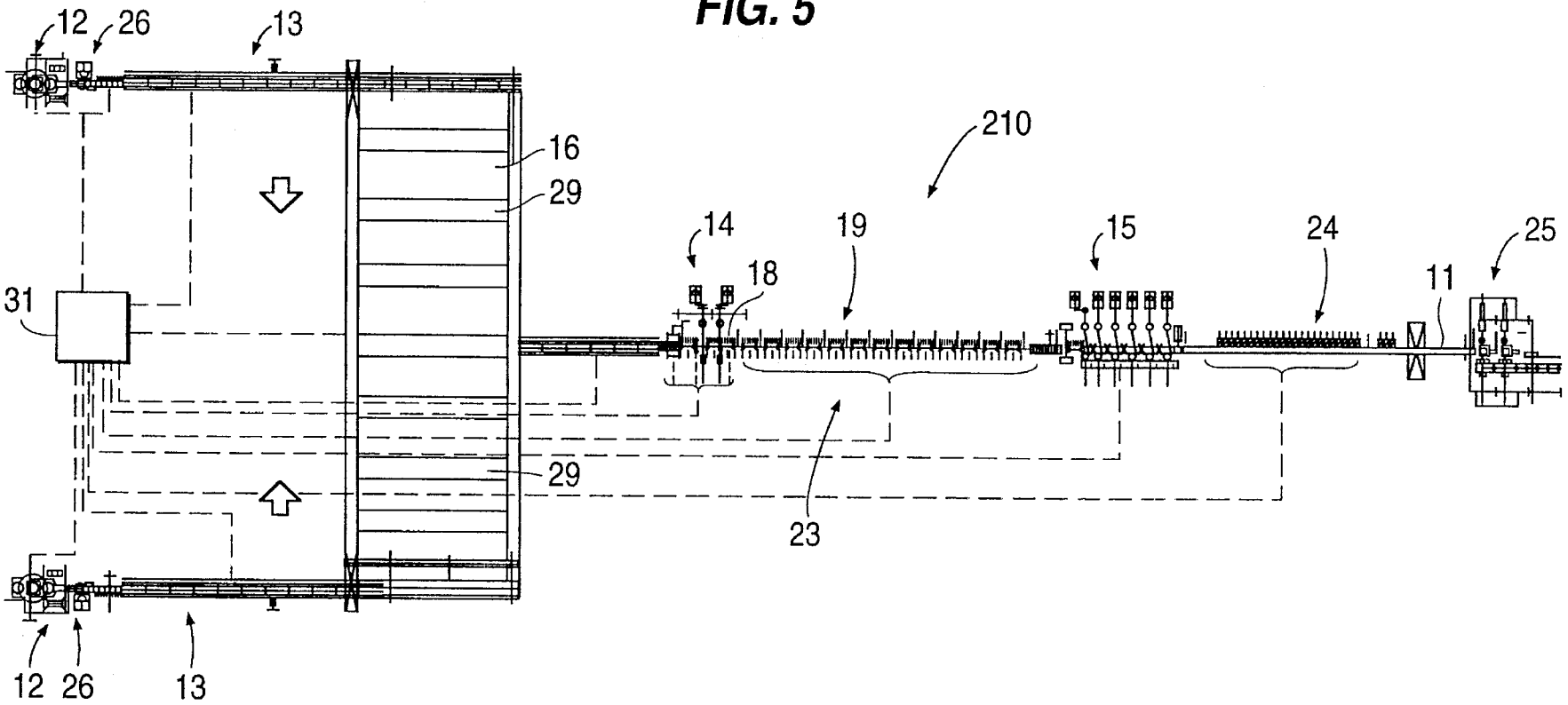
FIG. 5 is a plan view of a second variant of the plant to produce strip, starting from thin slabs, according to the invention.

FIG. 5 shows a plant 210 in which two continuous casting units 12 are positioned at the opposite sides of the at least temperature-maintaining furnace 16, while the rolling line is substantially located on the median line of the at least temperature-maintaining furnace 16.

The plant 10-110-210 according to the invention includes a data processing assembly 31 structured with a plurality of data processing units possessing differentiated levels of management, the data processing assembly 31 being associated with a plurality of monitors such as a casting speed monitor, a monitor for the temperature of the molten metal in the mould, a monitor for the temperature of the sidewall of the crystalliser, a monitor of surface faults on the thin slab 29, a monitor for the temperature of the thin slab 29, monitors of the speed of feed and temperature of the temporary store 13, monitors of the speed of feed and temperature of the at least temperature-maintaining furnace 16, monitors of the speed of feed and temperature of the tunnel furnace 23, monitors of the rolling pass (adjustment) and speed of feed of the roughing assembly 14 and of the machines associated therewith, monitors of the rolling pass (adjustment) and speed of feed of the finishing assembly 15 and of the machines associated therewith.

Instead of, or to assist and make comparisons with, the monitors, the data processing assembly 31 can contain a plurality of maps or files which relate the type of steel to the casting and processing characteristics and determine statistically, with a high degree of reliability, the characteristics or type of the working parameters at each point of the plant.

The data processing assembly 31 performs a plurality of functions including:

controlling the casting parameters and various systems;

the cooling speed;

the soft reduction;

controlling the continuous casting parameters with adaptation of the casting speed and other parameters in the event of an incipient danger of a break-out;

controlling and actuating the oscillation unit of the mould to determine the oscillation parameters such as amplitude, frequency and waveform of the oscillations;

controlling and regulating the speed of movement of the thin slab 29 at least in the at least temperature-maintaining furnace at least according to the surface faults;

controlling and regulating the rolling parameters (temperature, speed and thickness) in the roughing train 14 and finishing train 15 and the cooling parameters on the roller conveyor 24 at the outlet of the finishing train and the parameters of the winding of the reels.

Moreover, the data processing assembly 31, as it consists of a plurality of data processing units specialised in specific functions and interacting with each other on the basis of differentiated interactive levels of management, enables the path of the product leaving the crystalliser to be followed in its various transformations until it becomes the finished product.

This, together with the other functions, makes possible a complete and exhaustive control of the process, at the same time providing all the information connected to each point and result of the process.

This system enables the data processing assembly 31 to obtain information, to create new data storages, to rebalance the process and to act upstream when situations downstream make necessary some modifications of the upstream process.

Moreover, the data processing assembly 31, by storing anomalies at various points and momentary anomalies of this or that furnace or of this or that machine, is able to take action in the downstream passes to eliminate or at least to reduce considerably the qualitative faults which such anomaly or anomalies entail in the finished product.

What is claimed is:

1. Method to produce strip comprising the following steps: continuously casting thin slabs in a continuous casting plant while subjecting a mould of the continuous casting plant to an oscillation action the conformation of which is at least partly correlated with the casting parameters, wherein the thin slab leaving the crystalliser of the continuous casting plant has a thickness between 70 and 100 mm. and travels at a speed between 2 and 10 metres per minute; maintaining the thin slab at least in a furnace at least maintaining the temperature of the slab for a period correlated at least with the characteristics of the surface defects of the thin slab; rolling the thin slab in a roughing rolling step carried out at an outgoing speed of about 1.3 to 4 metres per second so as to produce as output a bar having a thickness between 16 and 40 mm.; rolling the bar in a finishing rolling step started with a speed between 30 and 85 metres per minute, depending on the finished thickness of the strip and the thickness of the bar, each step of the method being controlled by monitors and managed by a data processing assembly structured with a plurality of differentiated levels of management.

2. Method as in claim 1, whereby the oscillation action is carried out by an oscillation unit of a hydraulic type associated with the mould governed by the data processing assembly and is associated at least with means that monitor the casting speed and the temperature of the liquid metal in the mould, the data processing assembly determining at least two of the following parameters of the oscillation imparted to the mould by the oscillation unit: frequency, amplitude and waveform.

3. Method as in claim 1 whereby the speed of movement of the thin slab in the at least temperature-maintaining furnace is governed by the data processing assembly associated at least with a system to monitor/define surface faults on the thin slab and/or the type and quality of the steel.

4. Method as in claim 1, further comprising maintaining the thin slab in a temporary store having the purpose of maintaining or raising the temperature included between the continuous casting plant and the at least temperature-maintaining furnace.

5. Method as in claim 1 whereby the thickness of the bar leaving the roughing rolling step is between 20 and 25 mm.

6. Method as in claim 1, further comprising descaling the bar leaving the roughing rolling step in descaling step at least to lower its surface temperature to about 700° C.

7. Method as in claim 1, further comprising inverting the bar by a coil box between the roughing rolling step and the finishing rolling step.

8. Plant to produce strip, comprising a continuous casting plant having a mould for casting thin slabs, a furnace operatively associated with and downstream of the mould at least for maintaining the temperature of the thin slab, a roughing assembly operatively associated with and downstream of the furnace, and a data processing assembly operatively associated with the mould, the furnace and the roughing assembly, the plant being characterised in that it entails at least four of the following factors:

the mould includes a crystalliser having a thickness of its outlet between 70 and 100 mm.;

the mould is associated with a hydraulic oscillation unit governed by the data processing assembly;

the data processing assembly calculates and controls a stay time of the thin slab in the furnace to surface defects of the slab;

the roughing assembly produces as its output a bar having a thickness between 16 and 40 mm., and the finishing assembly receives the bar having a thickness between 16 and 40 mm. and travelling at an input speed between 30 and 85 metres per minute;

the data processing assembly, being associated with the various components of the plant by means of monitors and governing at least the furnace.

9. Plant to produce strip as in claim 8, in which the data processing assembly controls the hydraulic oscillation unit to adjust at least two of the following oscillation parameters:

amplitude of oscillation;

frequency of oscillation;

waveform.

10. Plant to produce strip as in claim 8, in which the data processing assembly is operatively associated at least with and receives data from means to monitor the casting speed and means to monitor the temperature of the liquid metal in the mould.

11. Plant to produce strip as in claim 8, further comprising a plurality of temperature monitors for measuring a temperature of molten metal in the mold and for measuring a temperature of a sidewall of the crystallizer, the plurality of temperature monitors being operatively associated with the data process system.

12. Plant to produce strip as in claim 8, in which the bar leaving the roughing assembly has a thickness between 20 and 25 mm.

13. Plant to produce strip as in claim 8, in which a shearing unit is provided between the continuous casting plant and the furnace for shearing thin slabs cast by the continuous casting plant.

14. Plant to produce strip as in claim 8, in which a temporary store having a length about 4 to 5 times the length of the sheared thin slab is included between the continuous casting plant and the temperature-maintaining furnace.

15. Plant to produce strip as in claim 8, wherein the continuous casting plant includes means for soft reduction of the cast slab, and wherein a shearing unit and, downstream thereof, a temporary store are provided between the continuous casting plant and the furnace for shearing thin slabs cast by the continuous casting plant and temporarily storing sheared thin slabs.

16. Plant to produce strip as in claim 8, in which a temperature-maintaining tunnel furnace is included between the roughing assembly and the finishing assembly.

17. Plant to produce strip as in claim 8, in which a coil box for head-to-tail inversion of the bar is included downstream of the roughing assembly and upstream of the finishing assembly.

18. Plant to produce strip as in claim 8, further comprising a temperature-maintaining tunnel furnace which includes burners provided between and operatively connected to the roughing assembly and the finishing assembly.

19. Plant to produce strip as in claims 8, in which the data processing assembly includes a plurality of specialised data processing units governed on the basis of differentiated levels of management.

* * * * *